US006056285A

United States Patent [19]

Kikuta et al.

[11] Patent Number: 6,056,285

[45] Date of Patent: May 2, 2000

[54] SHEET MATERIAL FEEDING DEVICE AND IMAGE FORMING DEVICE

[75] Inventors: Akira Kikuta; Kunimasa Kawamata; Tomohiko Nakamura; Takashi Toda, all of Saitama, Japan

[73] Assignee: Fuji Xerox Co., Ltd., Tokyo, Japan

[21] Appl. No.: 08/852,077

[22] Filed: May 6, 1997

[30] Foreign Application Priority Data

May 9, 1996 [JP] Japan ..... 8-115112

[51] Int. Cl.[7] ..... B65H 3/30

[52] U.S. Cl. ..... 271/118; 271/9.05

[58] Field of Search ..... 271/118, 127, 271/126, 9.05, 9.06, 9.13

[56] References Cited

U.S. PATENT DOCUMENTS

| | | | |
|---|---|---|---|
| 4,319,740 | 3/1982 | Ulseth | 271/118 |
| 4,717,139 | 1/1988 | Sootome et al. | 271/118 |
| 5,255,903 | 10/1993 | Parsons et al. | 271/118 |
| 5,358,230 | 10/1994 | Ikemori et al. | 271/118 |
| 5,678,814 | 10/1997 | Yokoyama et al. | 271/9.05 |

FOREIGN PATENT DOCUMENTS 3-13436 1/1991 Japan .

*Primary Examiner*—Gregory A. Morse

*Attorney, Agent, or Firm*—Finnegan, Henderson, Farabow, Garrett & Dunner, L.L.P.

[57] ABSTRACT

A sheet material feeding device includes: a press plate which is provided at a bottom portion of a cassette and on which sheet materials are loaded and which is swingable upward and downward; a feed roll which is positioned above the press plate and which feeds an uppermost sheet material of the sheet materials by rotating while contacting the uppermost sheet material; a limiting member provided above the press plate and limiting a stacked height of the sheet materials; a spring urging the press plate upward so that the uppermost sheet material abuts the limiting member; and a presser mechanism which swings the press plate downward against urging force of the spring when the uppermost sheet material is fed to a predetermined position by the feed roll. Accordingly, when the uppermost sheet material is fed to the predetermined position by the feed roll, the press plate is swung downward, and there is no frictional resistance between the limiting member and the uppermost sheet material.

9 Claims, 7 Drawing Sheets

SHEET MATERIAL FEEDING DEVICE AND IMAGE FORMING DEVICE

BACKGROUND OF THE INVENTION

1. Field of the Invention

The present invention relates to a sheet material feeding device, which feeds sheet materials such as papers to an image forming device, and to an image forming device which is equipped with the sheet material feeding device.

2. Description of the Related Art

The device illustrated in FIG. 6 is known as a conventional sheet material feeding device for feeding stiff papers (sheet materials) such as postcards, envelopes and the like. (Refer to Japanese Patent Application Laid-Open (JP-A) No. 3-13436.)

A sheet material feeding device 100 has a stacking stand 104 on which sheet materials 102 are stacked. The stacking stand 104 is provided at a cassette 105 which is loaded into an image forming device. The stacking stand 104 is usually urged upward by a coil spring 106 which is disposed between the stacking stand 104 and the bottom plate of the cassette 105.

A feed roller 108 having a segment-shaped end surface (i.e., having a substantially fan-shaped cross-section) is provided above the sheet materials 102. When the feed roller 108 rotates, a circular arc shaped surface 108B thereof abuts the upper surface of an uppermost sheet material 102A of the stacked sheet materials 102, so as to feed out the uppermost sheet material 102A.

A conveying roller pair 110 which is driven by a motor (not shown) is provided at the feeding direction downstream side of the sheet material 102A. The sheet material 102A which has been fed out by the feed roller 108 is nipped by the conveying roller pair 110 and conveyed downstream.

A pair of sheet material separating levers 112 which are swingable about a shaft 114 are provided at the transverse direction sides of the sheet materials 102. (The transverse direction of the sheet materials 102 is the direction orthogonal to the conveying direction thereof.) A height limiting member 116, which abuts the uppermost sheet material 102A and limits the height of the stacked sheet materials 102, projects from the sheet material separating lever 112 so as to be positioned above the stacked sheet materials 102.

When the feed roller 108 rotates and the circular arc shaped surface 108B abuts the top surface of the uppermost sheet material 102A, the circular arc shaped surface 108B pushes the stacked sheet materials 102 and the stacking stand 104 down against the urging force of the coil spring 106. Therefore, a gap is formed between the sheet material 102A which is being fed out and the height limiting member 116. As a result, the sheet material 102A is nipped by the conveying roller pair 110 and is smoothly fed out without any conveying resistance due to friction being generated between the sheet material 102A and the height limiting member 116.

However, as illustrated in FIG. 7, when the feed roller 108 is rotated further such that a segment shaped portion (a non circular arc shaped portion) 108A thereof is oriented downward, i.e., when the circular arc shaped surface 108B is oriented upward, the stacked sheet materials 102 and the stacking stand 104 are pushed upward by the urging force of the coil spring 106. As a result, the trailing end of the sheet material 102A which is being fed press-contacts the height limiting member 116, and the conveying resistance increases. In particular, when the sheet material 102 is stiff, the conveying resistance of the uppermost sheet material 102A markedly increases.

As a result, the conveying force of the conveying roller pair 110 must be made large, and the output of the motor for driving the conveying roller pair 110 must be made large. Accordingly, the motor becomes large, and much electric power is consumed. In particular, when the respective sheet materials 102 are being conveyed upward in a substantially vertical state, the conveying roller pair 110 must have a large conveying force. The increase in the size of the motor and the increase in the amount of power consumed are great drawbacks.

SUMMARY OF THE INVENTION

In view of the aforementioned, an object of the present invention is to provide a sheet material feeding device which, with a simple structure and by using a small motor having a small output, can feed not only sheet materials having ordinary stiffness such as regular papers, but also can feed thick sheet materials, and to provide an image forming device having this sheet material feeding device.

A first aspect of the present invention is a sheet material feeding device comprising: a press plate which is provided at a bottom portion of a cassette and on which sheet materials are loaded and which is swingable upward and downward; a feed roll which is positioned above the press plate and which feeds an uppermost sheet material of the sheet materials by rotating while contacting the uppermost sheet material; a limiting member provided above the press plate and limiting a stacked height of the sheet materials; urging means urging the press plate upward so that the uppermost sheet material abuts the limiting member; and a presser mechanism which swings the press plate downward against urging force of the urging means when the uppermost sheet material is fed to a predetermined position by the feed roll.

In the first aspect, the feed roll rotates and abuts the uppermost sheet material among the sheet materials loaded at the press plate. The uppermost sheet material is fed due to the friction between the feed roll and the uppermost sheet material. At this time, the press plate is urged upward by the urging means, and the uppermost sheet material is press-contacted by the feed roll and the limiting member.

During the feeding operation (i.e., rotation) of the feed roll, when the leading end of the uppermost sheet material being fed reaches the conveying means provided at the sheet material feeding direction side (e.g., when the uppermost sheet material is nipped by a pair of conveying rollers), i.e., at the time that the uppermost sheet material is fed to the predetermined position, interlockingly, the presser mechanism presses the press plate downward against the urging force of the urging means. As a result, the uppermost sheet material is press-contacted against the restricting member. Note that the press plate may be pressed downward simultaneously with the completion of the feeding operation of the feed roll.

Accordingly, conveying resistance due to friction between the uppermost sheet material which is being conveyed and the limiting member is not generated. Therefore, there is no need for a large conveying force at the conveying roller pair which nips and conveys the uppermost sheet material fed by the feed roll.

As a result, there is no need to make the motor output for driving the conveying roller pair large in consideration of conveying resistance due to the sheet material which is being conveyed press-contacting the limiting member. The motor can be made compact, and the amount of electric power consumed can be reduced.

In a second aspect of the present invention, in the first aspect, the presser mechanism includes: a driving gear provided at a rotating shaft of the feed roll; a link gear rotatably supported at a cassette so swing together with the press plate; and a gear mechanism which, when the uppermost sheet material is fed to the predetermined position by the feed roll, meshes with the driving gear, transmits rotating force of the feed roll to the link gear, and rotates the link gear so that the press plate swings downward.

In the second aspect, the driving gear rotates together with the feed roll, and the feed roll feeds the uppermost sheet material. When the uppermost sheet material reaches the predetermined position, the driving gear meshes with the gear mechanism. The gear mechanism transfers the rotation of the driving gear to the link gear so as to rotate the link gear. Due to the rotation of the link gear, the press plate is swung downward against the urging force of the urging means. In this way, because the height limiting member and the trailing end of the uppermost sheet material, which is being nipped and conveyed by the conveying roller pair, do not contact one another, conveying resistance is not generated in the conveying of the uppermost sheet material.

In a third aspect of the present invention, the sheet material feeding device of the second aspect further comprises: a cam groove provided at the rotating shaft of the feed roll and rotating together with the feed roll; a lock gear provided at the gear mechanism; a projection engageable with the cam groove; a lock claw able to lock the lock gear; and interlocking means for interlocking the projection and the lock claw such that, when the projection and the cam groove are engaged, the interlocking means locks the lock gear by the lock claw and prevents upward swinging of the press plate, and when the projection is out of the cam groove, the interlocking means cancels locking of the lock gear by the lock claw and swings the press plate upward by the urging means.

In the third aspect, when the feed roll for feeding the uppermost sheet material begins to rotate, the projection comes out of the cam groove, and due to the interlocking means, the lock claw cancels the locked state of the lock gear. Further, the driving gear is not meshed with the gear mechanism. As a result, the gear mechanism is rotatable in a free state. In this way, the link gear also becomes rotatable, and the press plate becomes swingable. Accordingly, the press plate is swung upward by the urging force of the urging means, and the uppermost sheet material is pressed by the feed roll and the limiting member and is fed due to the friction between the feed roll and the uppermost sheet material.

The leading end of the uppermost sheet material which is being fed is nipped by the conveying roller pair, and the uppermost sheet material is conveyed. When the uppermost sheet material moves downstream, the trailing end thereof separates from the feed roll. At this time, the driving gear and the gear mechanism mesh, and the rotating force of the feed roll is transmitted to the link gear. The press plate is pressed downward against the urging force of the urging means. As a result, the trailing end of the uppermost sheet material being fed does not press-contact the limiting member, and friction is not generated in the conveying of the uppermost sheet material.

Further, when the feed roll rotates, the projection and the cam groove engage. Due to the interlocking means, the lock claw locks the lock gear, and rotation of the gear mechanism is prevented. In this way, the state in which the press plate is pushed down is maintained. As a result, if the gear ratio of the driving gear and the gear mechanism is adjusted such that the press plate is pressed down a predetermined amount, this state can be maintained by the interlocking means. Therefore, the press plate is not pressed down excessively and does not swing upward due to the urging force of the urging means.

In a fourth aspect of the present invention, in the third aspect, the interlocking means includes: an arm formed in a substantial U-shape, an intermediate portion of the arm being rotatably supported, the projection being formed at one end of the arm, and the lock claw being formed at another end of the arm; and a plate spring urging the arm in a direction in which the projection engages the cam groove.

In the fourth aspect, when the arm is urged by the plate spring and the projection at one end of the arm engages with the cam groove, the lock claw at the other end of the arm locks the lock gear. When the feed roll begins to rotate, the projection comes out of the cam groove against the urging force of the urging means, and interlockingly, the lock claw separates from the lock gear so that the locked state of the lock gear is canceled. The projection and the lock claw are interlocked with this simple structure.

In a fifth aspect of the present invention, in the first aspect, the feed roll is rotated by driving force from a driving system of an image forming device for forming images onto the sheet materials fed from the sheet material feeding device.

Accordingly, there is no need to provide a separate driving device such as a motor or the like in order to drive the feed roll.

A sixth aspect of the present invention is an image forming device including: a sheet material feeding device which feeds sheet materials; and an image forming section which has a driving system conveying sheet materials fed from the sheet material feeding device and which forms images on the sheet materials, the sheet material feeding device comprising: a press plate which is provided at a bottom portion of a cassette and on which sheet materials are loaded and which is swingable upward and downward; a feed roll which is positioned above the press plate and which feeds an uppermost sheet material of the sheet materials by rotating while contacting the uppermost sheet material; a limiting member provided above the press plate and limiting a stacked height of the sheet materials; urging means urging the press plate upward so that the uppermost sheet material abuts the limiting member; and a presser mechanism which swings the press plate downward against urging force of the urging means when the uppermost sheet material is fed to a predetermined position by the feed roll.

In accordance with the sixth aspect, in the same way as in the first aspect, conveying resistance is not generated between the limiting member and the sheet material being conveyed.

A seventh aspect of the present invention is an image forming device including: a plurality of sheet material feeding devices which are operated to feed sheet materials; and an image forming section conveying sheet materials fed from the plurality of sheet material feeding devices, and forming images on the sheet materials, at least one sheet material feeding device among the plurality of sheet material feeding devices comprising: a press plate which is provided at a bottom portion of a cassette and on which sheet materials are loaded and which is swingable upward and downward; a feed roll which is positioned above the press plate and which feeds an uppermost sheet material of the sheet materials by rotating while contacting the uppermost sheet material; a limiting member provided above the press plate and limiting a stacked height of the sheet materials; urging means urging the press plate upward so that the uppermost sheet material abuts the limiting member; and a presser mechanism which swings the press plate downward against urging force of the urging means when the uppermost sheet material is fed to a predetermined position by the feed roll.

In accordance with the seventh aspect, the image forming device is provided with a plurality of sheet material feeding devices.

In the seventh aspect, at least one sheet material feeding device among the plurality of sheet material feeding devices has the structure of the first aspect, and the operation thereof is the same as the operation of the first aspect.

In an eighth aspect of the present invention, the image forming device of the seventh aspect further comprises selecting means for selecting and operating the at least one sheet material feeding device among the plurality of sheet material feeding devices. Accordingly, sheet materials having ordinary stiffness and sheet materials which are more stiff are set in different sheet material feeding devices. Either type of sheet material is selected as needed, and images are formed on the selected sheet materials.

DESCRIPTION OF THE PREFERRED EMBODIMENT

Figure 4:
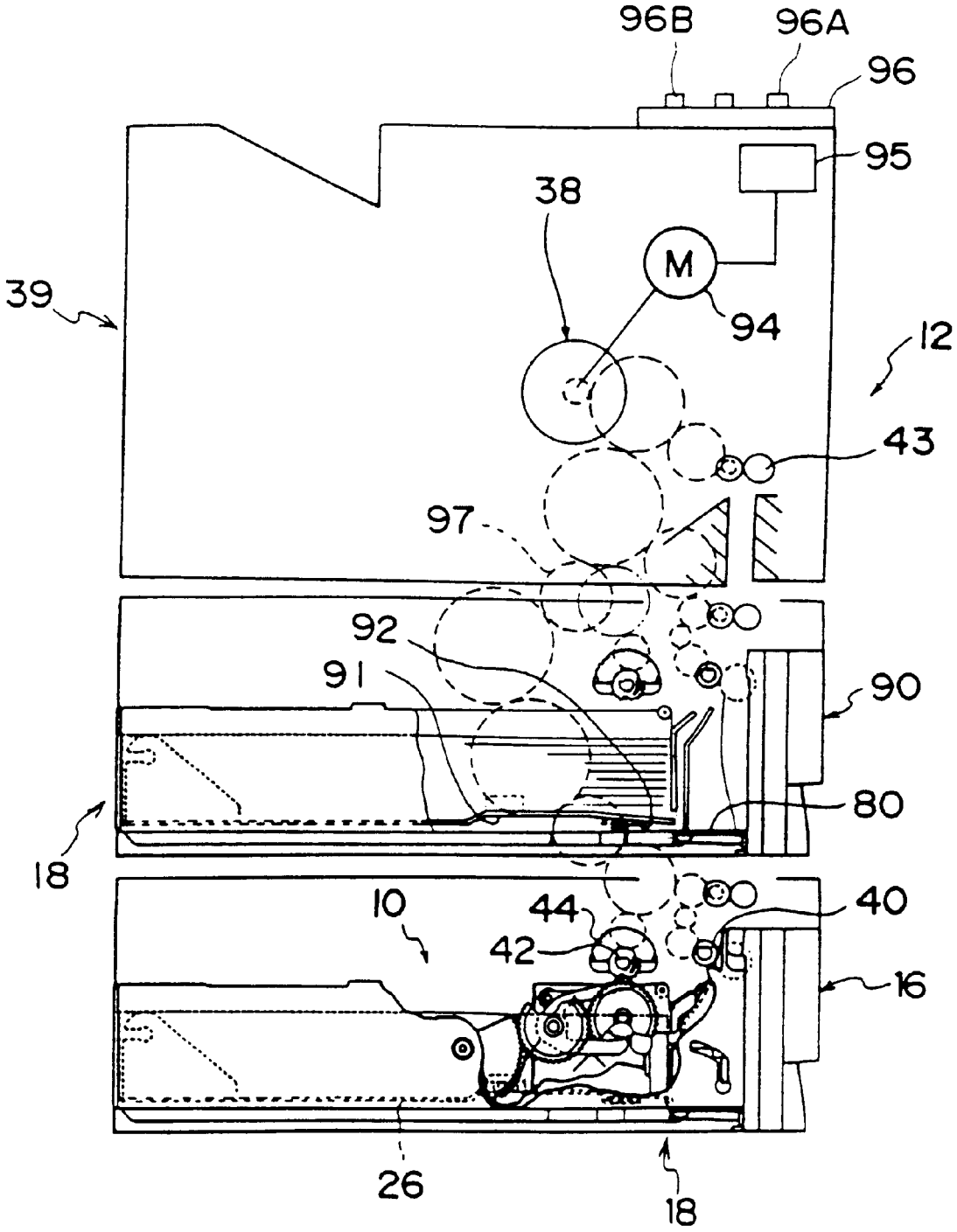
FIG. 4 is a schematic view of an image forming device to which the sheet material feeding device relating to the embodiment of the present invention is applied.

An image forming device 12 equipped with a sheet material feeding device 10 relating to an embodiment of the present invention is illustrated in FIG. 4. The image forming device 12 has two feeder sections 18, one disposed above the other. A cassette 90 is loaded into the upper feeder section 18. The cassette 90 is a conventional type cassette whose bottom plate 91 is always urged upward by a spring 92. A cassette 16 forming the sheet material feeding device 10 relating to the embodiment of the present invention is loaded into the lower feeder section 18. Of course, the cassette 16 may be loaded into the upper feeder section 18 and form the sheet material feeding device 10 relating to the embodiment of the present invention. Namely, either of the cassette 16 or the cassette 90 can be loaded into either of the upper and lower feeder sections 18, and the feeder section 18 in which the cassette 16 is loaded forms the sheet material feeding device 10. Further, although two feeder sections 18 are provided in the present embodiment, more feeder sections may be provided. Moreover, the cassette 16 and the cassette 90 each have a sheet material pass-though opening 80 through which a sheet material 14 passes. Accordingly, for example, even in a case in which one of the cassettes is loaded into the lower feeder section 18 and the other cassette is loaded into the upper feeder section 18, the sheet material 14 from the cassette loaded in the lower feeder section 18 can be conveyed upwardly via the opening 80 of the cassette loaded in the upper feeder section 18, i.e., can be conveyed to an image forming section 39 which will be described later.

Figure 1:
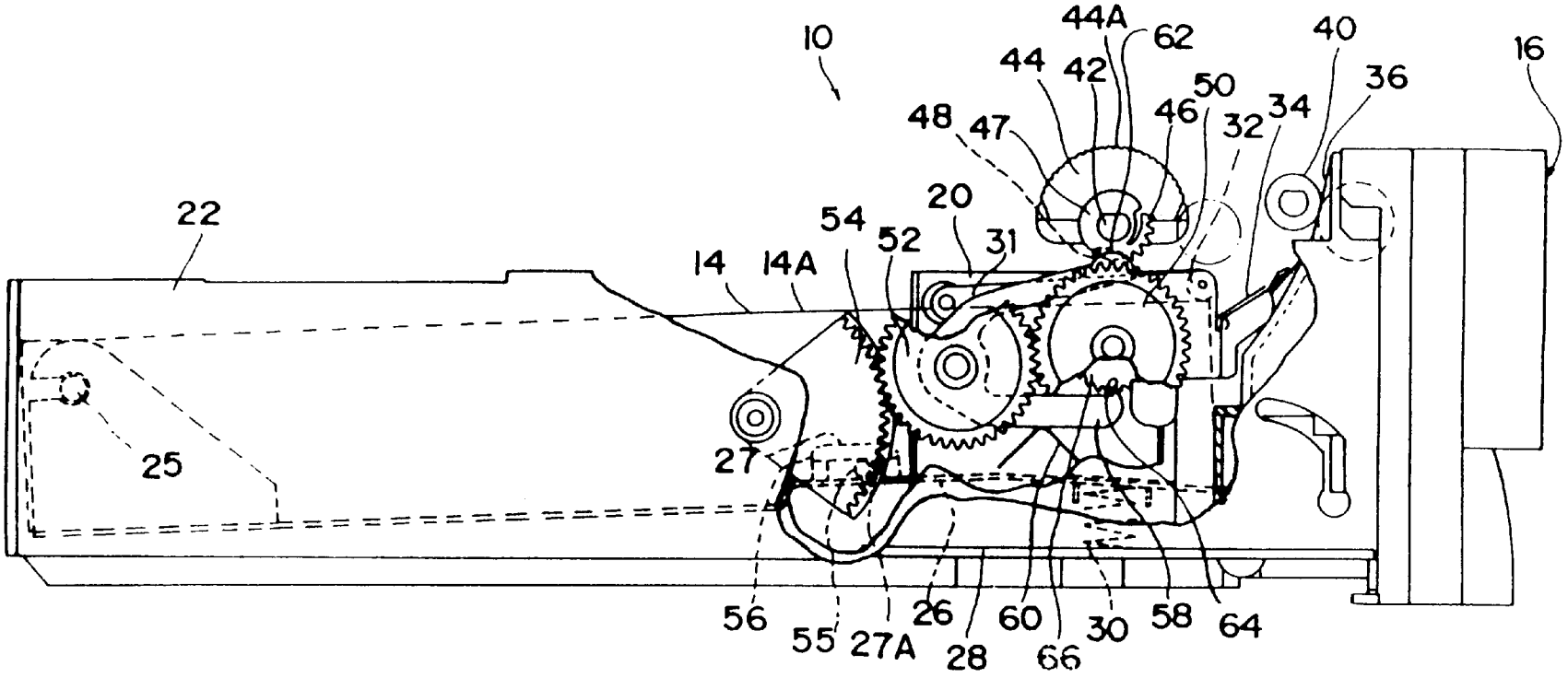
FIG. 1 is a partially broken side view of a sheet material feeding device relating to an embodiment of the present invention.

The sheet material feeding device 10 relating to the embodiment of the present invention is illustrated in detail in FIG. 1. The sheet material feeding device 10 is applicable not only to the feeding of sheet materials having ordinary stiffness such as regular papers, but also and in particular to the feeding of stiff sheet materials 14 such as postcards, envelopes, and the like.

The cassette 16, which is box-shaped and whose upper surface is open, can be inserted into and removed from the feeder section 18 (see FIG. 5) of the sheet material feeding device 10.

A press plate 26, whose end portion is swingably supported by a pin 25, is disposed at the bottom portion of the cassette 16. A coil spring 30 is disposed between the press plate 26 and a bottom plate 28. The press plate 26 is urged by the coil spring 30 in the direction of arrow A, i.e., in the counterclockwise direction (see FIG. 2).

A support plate 20 is provided upright at the side portion of the cassette 16. One end of a height limiting arm 31 is rotatably supported at the support plate 20, and rotates over a predetermined angle. A height limiting roller 32, which limits the stacked height of the sheet materials 14 stacked on the press plate 26, is provided at the other end of the height limiting arm 31. When the press plate 26 is swung in the direction of arrow A due to the urging force of the coil spring 30, a topmost sheet material 14A among the stacked sheet materials 14 abuts the height limiting roller 32. The height limiting arm 31 rotates upward, but the rotation stops after a slight amount of rotation, and the swinging of the press plate 26 also stops.

At the feeder section 18, a support beam 45 (see FIG. 5) spans across in the transverse direction of the sheet materials 14 so as to be positioned above the cassette. A rotating shaft 42 is supported at the support beam 45. Further, as illustrated in FIG. 4, the image forming device 12 is provided with the image forming section 39 for forming images on the sheet materials 14. A motor 94 and a conveying system 38 which is driven by the rotation of the motor 94 are provided in the image forming section 39 in order to convey the sheet materials 14 at the interior of the image forming section 39. The rotation of the motor 94 is controlled by a controller 95. The driving system 39 is provided with a gear 97 which is movable between the position illustrated by the dashed line and the position illustrated by the two-dot chain line. The gear 97 is controlled by the controller 95 so as to be positioned at either of these two positions. The rotating shaft 42 is rotated and driven by the driving system 39. A feed roll 44, which has a substantially half-moon shaped configuration as viewed from the side (i.e., has a half-moon shaped cross-sectional configuration), is attached to the rotating shaft 42. The rotating shaft 42 and the feed roll 44 attached to the rotating shaft 42 are provided at each of the two feeder sections 18. The gear 97 is moved to one of the aforementioned two positions via the controller 95, and the feed roll 44 corresponding to the position to which the gear 97 is moved is rotated by the driving system 38.

Figure 2:
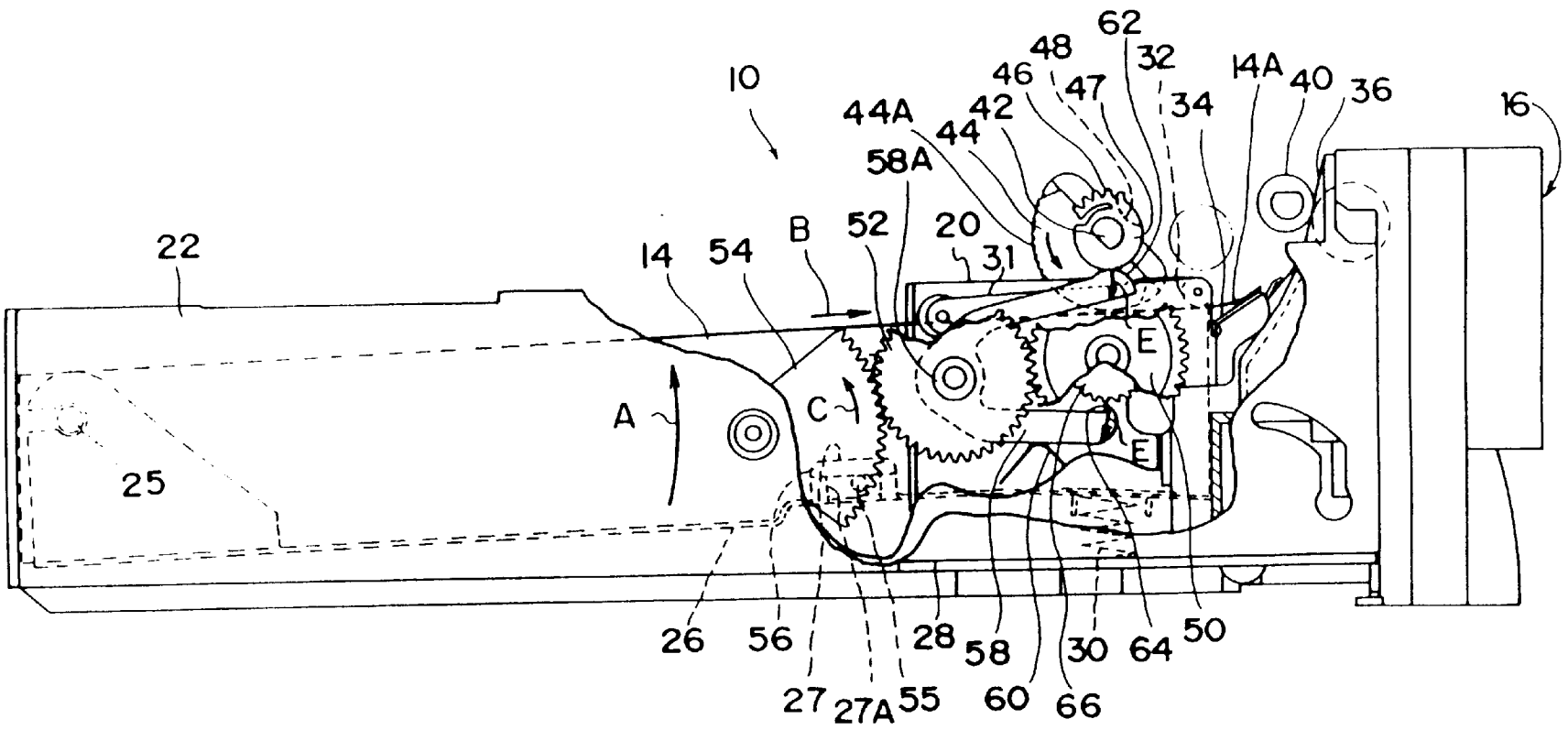
FIG. 2 is a partially broken side view of the sheet material feeding device relating to the embodiment of the present invention.

As illustrated in FIG. 1, when a circular arc shaped surface 44A of the feed roll 44 is positioned so as to be directed upwardly, even if the press plate 26 swings in the direction of arrow A due to the urging force of the coil spring 30, the feed roll 44 does not abut the uppermost sheet material 14A because the top surface of the uppermost sheet material 14A abuts the height limiting roller 32. On the other hand, as illustrated in FIG. 2, when the circular arc shaped surface 44A is directed downward due to the rotation of the feed roll 44, the circular arc shaped surface 44A abuts the sheet material 14A. As a result, by the rotation of the feed roll 44, the sheet material 14A is fed in the direction of arrow B due to the frictional force between the sheet material 14A and the circular arc shaped surface 44A. Note that a plurality of grooves may be formed in the circular arc shaped surface 44A along the axial direction of the feed roll 44 so that the frictional force between the circular arc shaped surface 44A and the sheet material 14A does not become great.

A shaft 47 is fixed to the end portion of the rotating shaft 42. Teeth are formed at a portion of the outer peripheral surface of the shaft 47 so as to form a pressing releasing gear 46. A cut-in is formed at a portion of the pressing releasing gear 46 so that the pressing releasing gear 46 can bend slightly toward the center of the rotating shaft 42.

A cam groove 48, with which a projection 62 which will be described later engages, is formed in the shaft 47.

A first transmission gear 50 is provided at the supporting plate 20 so as to be positioned beneath the rotating shaft 42. The pressing releasing gear 46 meshes with the first transmission gear 50 at the time that the feeding operation of the feed roll 44 is completed, i.e., at the time that the operations of the feed roll 44 rotating, the leading end of the sheet material 14A reaching a conveying roller pair 40 which will be described later, and the circular arc shaped surface 44A separating from the sheet material 14A are completed.

A second transmission gear 52 which meshes with the first transmission gear 50 is provided at the support plate 20 and rotates together with the first transmission gear 50.

A link gear 54, which is substantially fan shaped as seen from the side, is provided at the side portion of the cassette 16 at the left side of the second transmission gear 52 as seen in the figures, and meshes with the second transmission gear 52. A pin 55 projects from the link gear 54, and is inserted into a link hole 27A formed at a connecting plate 27 which stands upright from the press plate 26. In this way, when the link gear 54 rotates, the pin 55 is moved into the link hole 27A, and the press plate 26 swings about the pin 25.

A central portion 58A (see FIG. 2) of an arm 58, which is substantially U-shaped when seen from the side, is rotatably supported at the rotating shaft of the second transmission gear 52. The arm 58 is always urged to rotate in the direction opposite to the direction of arrow E (see FIG. 2) by a plate spring 60 provided in the cassette 16.

The projection 62 which can engage with the cam groove 48 of the shaft 47 is formed at one end of the arm 58. As illustrated in FIG. 1, in the state in which the circular arc shaped surface 44A of the feed roll 44 is oriented upward, the projection 62 engages with the cam groove 48. When the feed roll 44 rotates slightly, the projection 62 comes out of the cam groove 48. In this way, the projection 62 is pushed by the circular arc shaped portion of the shaft 47, and the arm 58 rotates in the direction of arrow E against the urging force of the plate spring 60.

A lock claw 64 is formed at the other end of the arm 58. The lock claw 64 has a lock surface 64A and a taper surface 64B (see FIG. 5). The rotation of the first transmission gear 50 in the counterclockwise direction (the direction of arrow F) is prevented by the lock surface 64A meshing with a lock gear 66 which is fixed coaxially with the first transmission gear 50. The clockwise rotation of the first transmission gear 50 is not locked because the lock gear 66 slides along the taper surface 64B.

A plate which is inclined upward is provided along the feeding direction (the direction of arrow B in FIG. 2) of the sheet materials 14A at the supporting plate 20 in the vicinity of the other end of the height limiting arm 31. A preventing pad 34, which prevents plural sheet materials from being fed simultaneously, is adhered to this plate. The angle at which the preventing pad 34 is inclined is set to an angle such that, even if two sheet materials 14 are fed together one on top of the other due to frictional force between the sheet materials 14, when the leading ends thereof abut the preventing pad 34, the lower sheet material 14 of these two sheet materials 14 is stopped and only the uppermost sheet material 14A is fed. In this way, simultaneous feeding of plural sheet materials 14 can be prevented.

A guide wall 36 which curves in a circular arc shape is provided at the sheet material 14A conveying direction side of the preventing pad 34, and guides the sheet material 14A to the conveying roller pair 40. Further, as illustrated in FIG. 4, conveying roller pairs 41, 43 are provided within the image forming device 12 above the cassette 16, and convey the sheet material 14A in order. The conveying roller pairs 40, 41, 43 are driven by the driving system 38.

Figure 5:
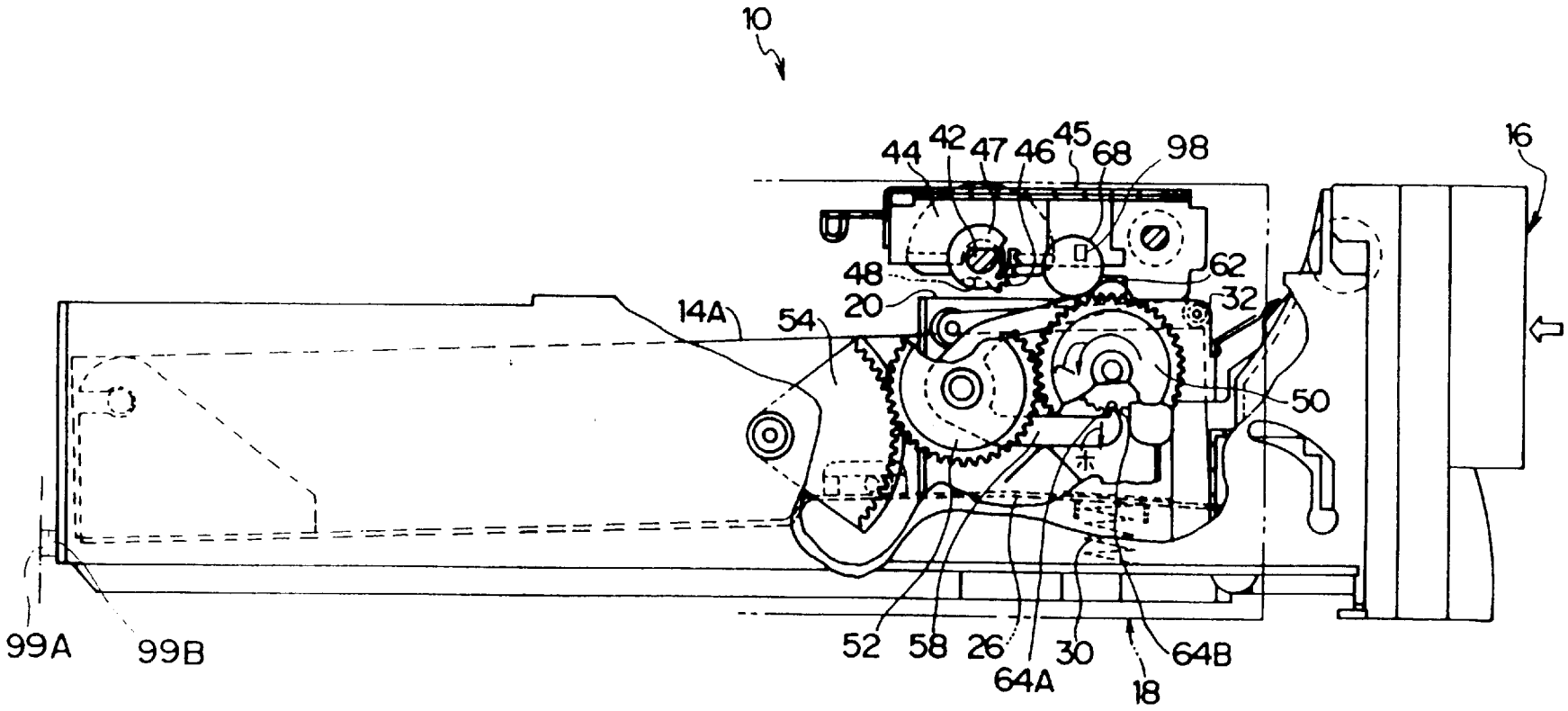
FIG. 5 is a partially broken side view of the sheet material feeding device relating to the embodiment of the present invention.
Figure 6:
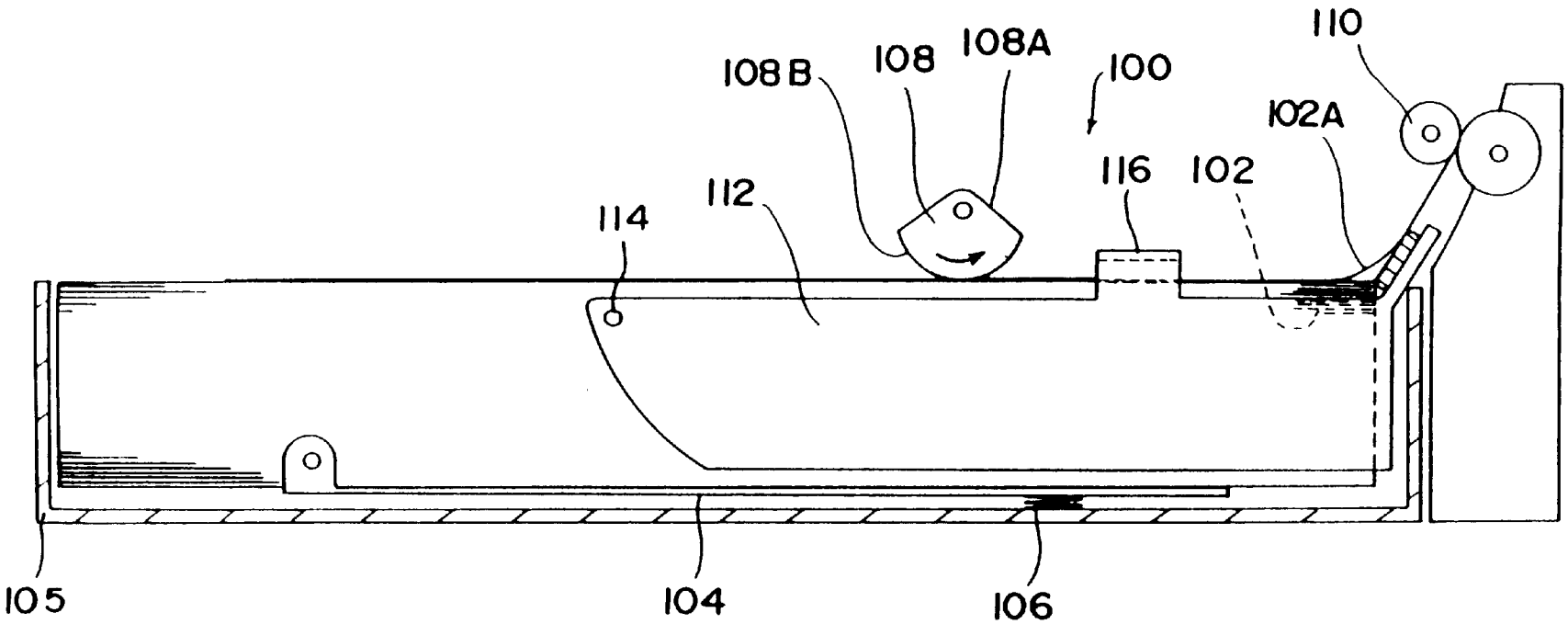
FIG. 6 PRIOR ART
FIG. 6 is an explanatory view of a conventional sheet material feeding device.
Figure 7:
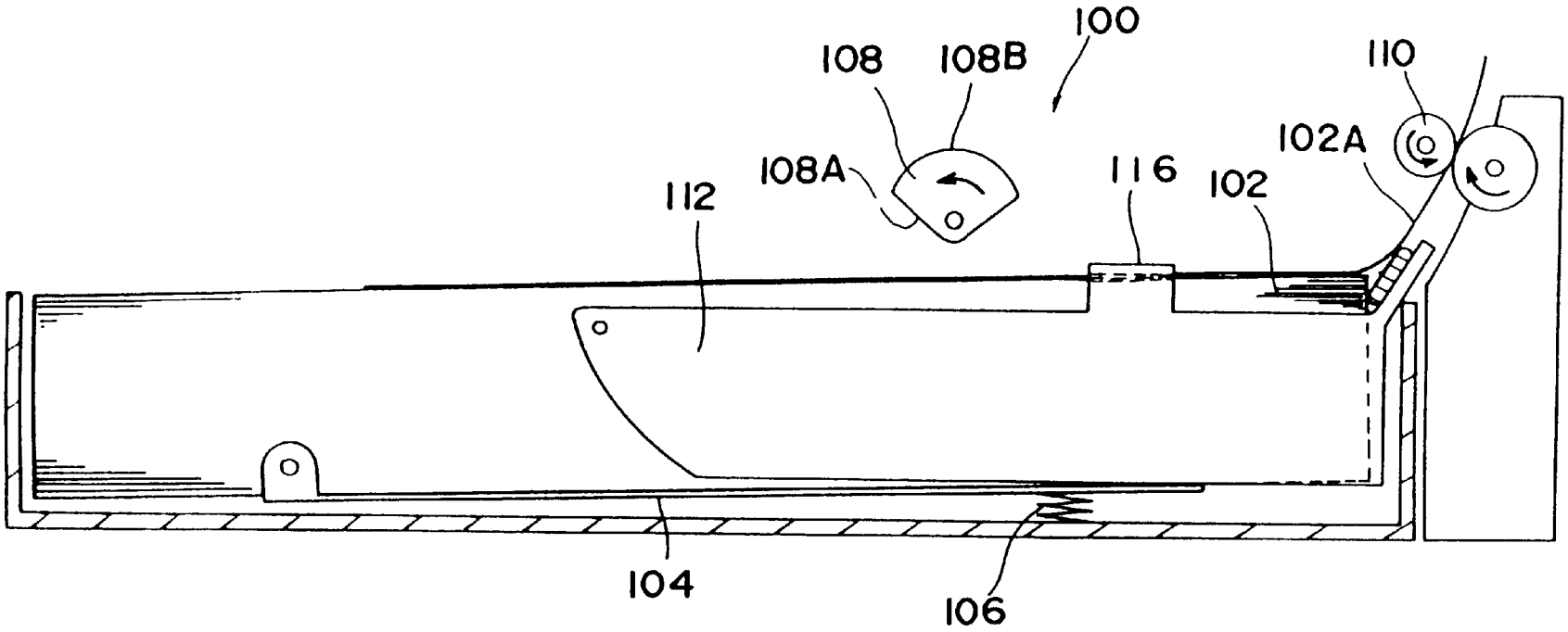
FIG. 7 PRIOR ART
FIG. 7 is an explanatory view of the conventional sheet material feeding device.

As illustrated in FIG. 5, a releasing projection 68, which the projection 62 abuts when the cassette 16 is being inserted (loaded), is provided at the supporting beam 45. More specifically, while the cassette 16 in which sheet materials 14 are stacked on the press plate 26 is being inserted into the feeder section 18, because the projection 62 abuts the releasing projection 68, the arm 58 is rotated slightly in the direction of arrow E, and the meshing of the lock claw 64 and the lock gear 66 is released temporarily. Further, a sensor 98 is provided at the releasing projection 68. The sensor 98 detects that the projection 62 has abutted the releasing projection 68 as the cassette 16 is being inserted and as the cassette 16 is being withdrawn. Due to the sensor 98, it can be detected that the cassette 16 is loaded in the feeder section 18 by the projection 62 abutting the releasing projection 68 as the cassette 16 is being inserted into the feeder section 18. Further, due to the sensor 98, it can also be detected that the cassette 16 has been withdrawn from the feeder section 18 by the projection 62 abutting the releasing projection 68 as the cassette 16 is being withdrawn from the feeder section 18. These detection signals are sent to the controller 95, and due to the controller 95, it is displayed on a display portion provided at an operation panel 96 whether the cassette 16 is loaded. Note that when the cassette 90 is inserted into and withdrawn from the feeder section 18, such detection signals are not generated because the cassette 90 is not provided with the projection 62. Further, in place of the sensor 98, a switch 99A illustrated by the imaginary line in FIG. 5 may be provided at the feeder section 18, and a presser portion 99B may be provided at the loading direction end portion of the cassette 16. In this case, when the cassette 16 is inserted into the feeder section 18, the switch 99A is turned on by the presser portion 99B, and it can be detected that the cassette 16 is loaded. When the cassette 16 is withdrawn from the feeder section 18, the switch 99A is turned off. Further, the loading of the cassette into the feeder section 18, the size of the sheet materials 14 stacked in the cassette, and the like are detected by sensors provided separately and are displayed on the above-mentioned display portion. Various buttons for implementing various functions are provided at the operation panel 96. For example, a cassette selection button 96A, which selects one of the cassettes loaded in the two feeder sections 18, and a start button 96B, which implements the formation of images onto the sheet materials stacked in the selected cassette, and the like are provided at the operation panel 96.

Next, operation of the sheet material feeding device 10 relating to the present embodiment will be described.

First, a case will be described in which the sheet materials 14 are stacked on the press plate 26 with the cassette 16 removed from the feeder section 18. The arm 58 is always urged in the direction opposite the direction of arrow E by the urging force of the plate spring 60, such that the lock gear 66 and the lock claw 64 are engaged. In the state in which the lock gear 66 and the lock claw 64 are engaged, counterclockwise rotation of the lock gear 66 is prevented, but the lock gear 66 slides along the taper surface 64B of the lock claw 64 such that the lock gear 66 can rotate in the clockwise direction in FIG. 2. More specifically, in FIG. 2, the first transmission gear 50 can rotate clockwise, the second transmission gear 52 can rotate counterclockwise, and the link gear 54 can rotate clockwise. Accordingly, when the press plate 26 is pressed in the direction opposite the direction of arrow A (i.e., is pressed downward) against the urging force of the coil spring 30, the gears 54, 52, 50 rotate in the aforementioned directions via the pin 55 and the link hole 27, and the press plate 26 can be positioned at a lower position. Further, because counterclockwise rotation of the lock gear 66, i.e., the first transmission gear 50, is prevented, the press plate 26 is locked at this pressed-down position.

As a result, the press plate 26 is pressed down to the bottom, a large space for stacking the sheet materials 14 is ensured, and a large amount of sheet materials 14 can be stacked.

Next, when the cassette 16 is inserted into, for example, the lower feeder section 18, as the cassette 16 is being loaded, as illustrated in FIG. 5, the projection 62 of the arm 58 abuts and is pushed by the releasing projection 62 of the feeder section 18, and the arm 58 rotates slightly in the direction of arrow E. In this way, the lock surface 64A of the lock claw 64 separates from the lock gear 66, and the first transmission gear 50 can rotate counterclockwise, the second transmission gear 52 can rotate clockwise, and the link gear 54 can rotate counterclockwise. Accordingly, due to urging force of the coil spring 30, the press plate 26 swings in the direction of arrow A, the uppermost sheet material 14A abuts the height limiting roller 32, and the swinging of the press plate 26 is stopped. In this state, as illustrated in FIG. 1, the cassette 16 is loaded into the lower feeder section 18. At this time, the sensor 98 detects that the cassette 16 has been loaded into the lower feeder section 18 due to the abutment of the projection 62 and the releasing projection 68, and via the controller 95, it is displayed on the display portion of the operation panel 96 that the cassette 16 has been loaded to the lower feeder section 18.

At this time, the circular arc shaped surface 44A of the feed roll 44 is directed upward. Further, when the projection 62 contacts and passes over the releasing projection 68, the arm 58 rotates in the direction opposite the direction of arrow E due to the urging force of the plate spring 60, and the projection 62 engages with the cam groove 48. As a result, the lock claw 64 engages with the lock gear 66, and rotation of the lock gear 66 in the counterclockwise direction is prevented. More specifically, the rotation of the first transmission gear 50 in the counterclockwise direction, the rotation of the second transmission gear 52 in the clockwise direction, and the rotation of the link gear 54 in the counterclockwise direction are respectively prevented. Accordingly, the counterclockwise direction swinging of the press plate 26 (the upward rotation of the press plate 26) due to the urging force of the coil spring 30 is prevented.

Next, the cassette selection button 96A of the operation panel 96 is pressed so that the lower cassette 16 is selected. Next, when the start button 96B is pressed, the formation of images onto the sheet materials 14 is effected. More specifically, as illustrated in FIG. 2, when the feed roll 44 begins to rotate, the projection 62 comes out of the cam groove 48 and is pushed by the circular arc shaped portion of the shaft 47, and the arm 58 rotates in the direction of arrow E against the urging force of the plate spring 60. As a result, the lock claw 64 separates from the lock gear 66, and rotation of the lock gear 66 in the counterclockwise direction is permitted. In this way, counterclockwise rotation of the first transmission gear 50, clockwise rotation of the second transmission gear 52, and counterclockwise rotation of the link gear 54 are permitted. Accordingly, the upward urging force of the coil spring 30 acts on the press plate 26, and the press plate 26 swings upward.

Next, the feed roll 44 is rotated, and the circular arc shaped surface 44A is moved downward and abuts the uppermost sheet material 14A. In the state in which the circular arc shaped surface 44A abuts the uppermost sheet material 14A, the press plate 26 is urged upward as described above. Accordingly, due to the relative friction between the circular arc shaped surface 44A and the sheet material 14A, the sheet material 14A is reliably fed in the direction of arrow B.

The leading end of the fed sheet material 14A abuts the preventing pad 34, and the sheet material 14A is guided upward at an angle. The sheet material 14A is then guided along the guide wall 36, and the leading end of the sheet material 14A is nipped by the conveying roller pair 40. In this way, the sheet material 14A is conveyed.

The feed roll 44 is rotated further, the circular arc shaped surface 44A separates from the sheet material 14A, and the operation for feeding the sheet material 14A by the feed roll 44 is completed. Simultaneously, with the completion of the feeding operation, the pressing releasing gear 46 meshes with the first transmission gear 50, and the rotation of the feed roll 44 is transmitted to the first transmission gear 50, i.e., the first transmission gear 50 is rotated clockwise. In this way, the second transmission gear 52 is rotated counterclockwise, and the link gear 54 is rotated in the direction of arrow D (clockwise). The press plate 26 is swung in the direction opposite to the direction of arrow A (i.e., downward) against the urging force of the coil spring 30.

At this time, the trailing end of the uppermost sheet material 14A which is nipped and conveyed by the conveying roller pair 40 is at the feeding direction upstream side of the height limiting roller 32. The press plate 26 swings in the direction opposite to the direction of arrow A, and a gap is formed between the uppermost sheet material 14A and the height limiting roller 32. Because no friction is generated between the sheet material 14A and the height limiting roller 32, no resistance is provided against the conveying of the sheet material 14A.

As a result, there is no need to make the conveying force of the conveying roller pair 40 large in consideration of the frictional resistance due to the sheet material 14A abutting the height limiting roller 32. Namely, the driving system 38 which drives the conveying roller pair 40 can be made small, and the amount of electric power consumed can be reduced.

Figure 3:
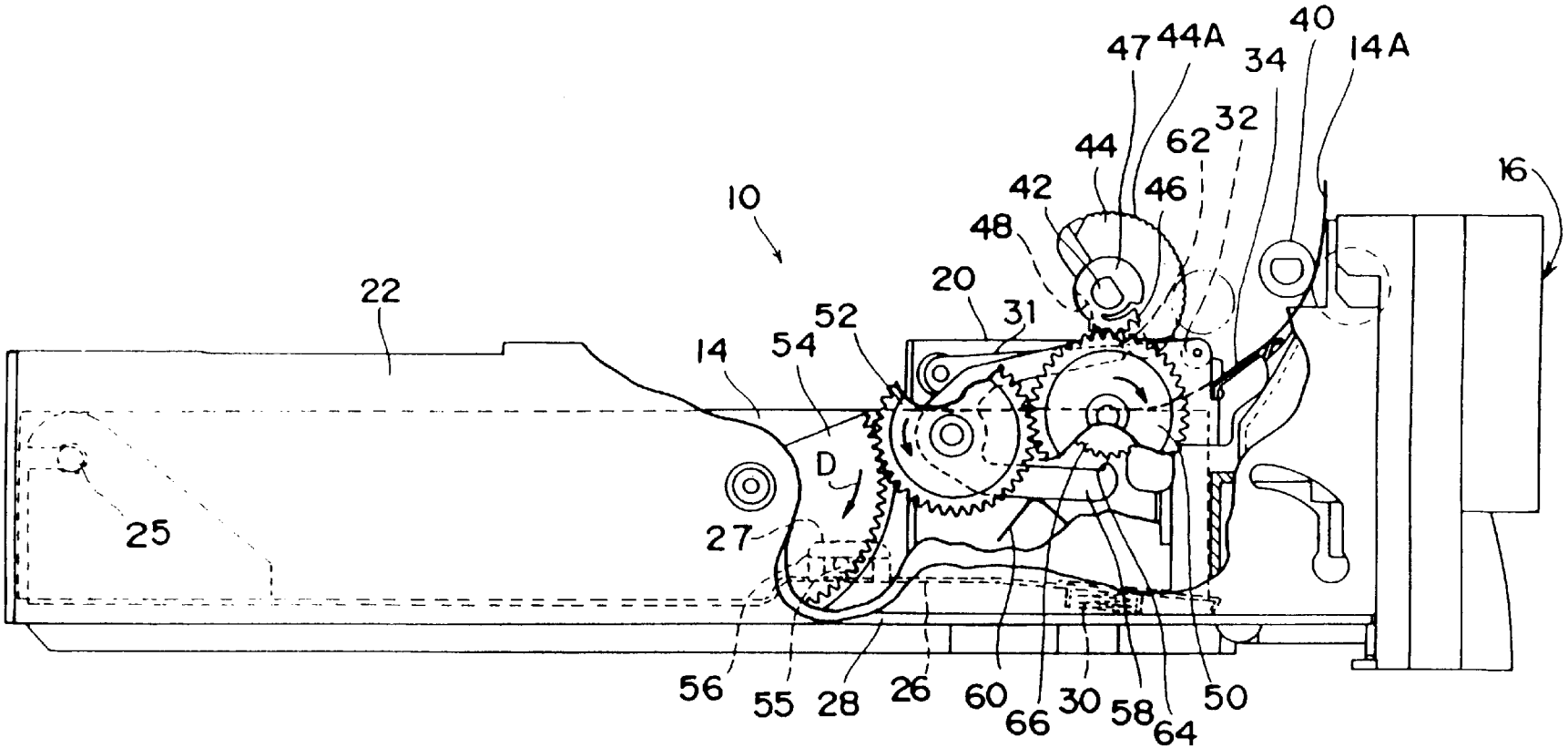
FIG. 3 is a partially broken side view of the sheet material feeding device relating to the embodiment of the present invention.

When the feed roll 44 is rotated further from the state illustrated in FIG. 3, the pressing releasing gear 46 separates from the first transmission gear 50. At this time, because the projection 62 is pressed by the circular arc shaped portion of the shaft 47, the lock claw 64 separates from the lock gear 66, and the first transmission gear 50 can rotate counterclockwise, the second transmission gear 52 can rotate clockwise, and the link gear 54 can rotate counterclockwise. As a result, the press plate 26 swings in the direction of arrow A due to the urging force of the coil spring 30.

When the feed roll 44 rotates further, the circular arc shaped surface 44A is directed upward and returns to the original state as illustrated in FIG. 1. At this time, because the projection 62 of the arm 58 engages with the cam groove 48, the arm 58 rotates in the direction opposite to the direction of arrow E due to the urging force of the plate spring 60. In this way, the lock claw 64 and the lock gear 66 engage, and counterclockwise rotation of the lock gear 66 is prevented. Counterclockwise rotation of the first transmission gear 50, clockwise rotation of the second transmission gear 52, and counterclockwise rotation of the link gear 54 are prevented, and swinging of the press plate 26 upward is prevented.

If the feed roll 44 is rotated, the next sheet material 14 can be fed in the same way as described above.

In the present embodiment, simultaneously with the completion of the feeding operation of the feed roll 44, the pressing releasing gear 46 meshes with the first transmission gear 50 and the press plate 26 is pressed down. However, a structure may be provided in which, for example, by changing the position of the pressing releasing gear 46, even during the feeding operation of the feed roll 44, if the leading end of the sheet material 14A reaches the conveying roller pair 40, the pressing releasing gear 46 meshes with the first transmission gear 50, and the press plate 26 is pressed down.

What is claimed is:

1. A sheet material feeding device comprising:

a press plate which is provided at a bottom portion of a cassette and on which sheet materials are loaded and which is swingable upward and downward;

a feed roll which is positioned above the press plate and which feeds an uppermost sheet material of the sheet materials by rotating while contacting the uppermost sheet material;

a limiting member provided above said press plate and limiting a stacked height of the sheet materials;

urging means urging said press plate upward so that the uppermost sheet material abuts said limiting member; and a presser mechanism which swings said press plate downward against urging force of said urging means when the uppermost sheet material is fed to a predetermined position by said feed roll;

said presser mechanism including:

a driving gear provided at a rotating shaft of said feed roll;

a link gear rotatably supported at a cassette so as to swing together with said press plate; and a gear mechanism which, when the uppermost sheet material is fed to the predetermined position by said feed roll, meshes with said driving gear, transmits rotating force of said feed roll to said link gear, and rotates said link gear so that said press plate swings downward.

2. A sheet material feeding device according to claim 1, further comprising:

a cam groove provided at the rotating shaft of said feed roll and rotating together with said feed roll;

a lock gear provided at said gear mechanism;

a projection engageable with said cam groove;

a lock claw able to lock said lock gear; and interlocking means for interlocking said projection and said lock claw such that, when said projection and said cam groove are engaged, said interlocking means locks said lock gear by said lock claw and prevents upward swinging of said press plate, and when said projection is out of said cam groove, said interlocking means cancels locking of said lock gear by said lock claw and swings said press plate upward by said urging means.

3. A sheet material feeding device according to claim 2, wherein said interlocking means includes:

an arm formed in a substantial U-shape, an intermediate portion of said arm being rotatably supported, said projection being formed at one end of said arm, and said lock claw being formed at another end of said arm; and a plate spring urging said arm in a direction in which said projection engages said cam groove.

4. An image forming device including:

a sheet material feeding device which feeds sheet materials; and an image forming section which has a driving system conveying sheet materials fed from said sheet material feeding device and which forms images on the sheet materials;

said sheet material feeding device comprising:

a press plate which is provided at a bottom portion of a cassette and on which sheet materials are loaded and which is swingable upward and downward;

a feed roll which is positioned above the press plate and which feeds an uppermost sheet material of the sheet materials by rotating while contacting the uppermost sheet material;

a limiting member provided above said press plate and limiting a stacked height of the sheet materials;

urging means urging said press plate upward so that the uppermost sheet material abuts said limiting member; and a presser mechanism which swings said press plate downward against urging force of said urging means when the uppermost sheet material is fed to a predetermined position by said feed roll;

said presser mechanism including:

a driving gear provided at a rotating shaft of said feed roll;

a link gear rotatably supported at a cassette so as to swing together with said press plate; and a gear mechanism which, when the uppermost sheet material is fed to the predetermined position by said feed roll, meshes with said driving gear, transmits rotating force of said feed roll to said link gear, and rotates said link gear so that said press plate swings downward.

5. An image forming device according to claim 4, further comprising:

a cam groove provided at the rotating shaft of said feed roll and rotating together with said feed roll;

a lock gear provided at said gear mechanism;

a projection engageable with said cam groove;

a lock claw able to lock said lock gear; and interlocking means for interlocking said projection and said lock claw such that, when said projection and said cam groove are engaged, said interlocking means locks said lock gear by said lock claw and prevents upward swinging of said press plate, and when said projection is out of said cam groove, said interlocking means cancels locking of said lock gear by said lock claw and swings said press plate upward by said urging means.

6. An image forming device according to claim 5, wherein said interlocking means includes:

an arm formed in a substantial U-shape, an intermediate portion of said arm being rotatably supported, said projection being formed at one end of said arm, and said lock claw being formed at another end of said arm; and a plate spring urging said arm in a direction in which said projection engages said cam groove.

7. An image forming device including:

a plurality of sheet material feeding devices which are operated to feed sheet materials; and an image forming section conveying sheet materials fed from said plurality of sheet material feeding devices, and forming images on the sheet materials, at least one sheet material feeding device among said plurality of sheet material feeding devices comprising:

a press plate which is provided at a bottom portion of a cassette and on which sheet materials are loaded and which is swingable upward and downward;

a feed roll which is positioned above the press plate and which feeds an uppermost sheet material of the sheet materials by rotating while contacting the uppermost sheet material;

a limiting member provided above said press plate and limiting a stacked height of the sheet materials;

urging means urging said press plate upward so that the uppermost sheet material abuts said limiting member; and a presser mechanism which swings said press plate downward against urging force of said urging means when the uppermost sheet material is fed to a predetermined position by said feed roll;

said presser mechanism including:

a driving gear provided at a rotating shaft of said feed roll;

a link gear rotatably supported at a cassette so as to swing together with said press plate; and a gear mechanism which, when the uppermost sheet material is fed to the predetermined position by said feed roll, meshes with said driving gear, transmits rotating force of said feed roll to said link gear, and rotates said link gear so that said press plate swings downward.

8. An image forming device according to claim 7, further comprising:

a cam groove provided at the rotating shaft of said feed roll and rotating together with said feed roll;

a lock gear provided at said gear mechanism;

a projection engageable with said cam groove;

a lock claw able to lock said lock gear; and interlocking means for interlocking said projection and said lock claw such that, when said projection and said cam groove are engaged, said interlocking means locks said lock gear by said lock claw and prevents upward swinging of said press plate, and when said projection is out of said cam groove, said interlocking means cancels locking of said lock gear by said lock claw and swings said press plate upward by said urging means.

9. An image forming device according to claim 8, wherein said interlocking means includes:

an arm formed in a substantial U-shape, an intermediate portion of said arm being rotatably supported, said projection being formed at one end of said arm, and said lock claw being formed at another end of said arm; and a plate spring urging said arm in a direction in which said projection engages said cam groove.

* * * * *